US011189260B2

(12) United States Patent
Pinter

(10) Patent No.: US 11,189,260 B2
(45) Date of Patent: Nov. 30, 2021

(54) ACTIVE NOISE-CANCELLING HEADPHONES

(71) Applicant: AUSTRIAN AUDIO GmbH, Vienna (AT)

(72) Inventor: Bernhard Pinter, Moosbrunn (AT)

(73) Assignee: AUSTRIAN AUDIO GMBH, Vienna (AT)

( * ) Notice: Subject to any disclaimer, the term of this patent is extended or adjusted under 35 U.S.C. 154(b) by 0 days.

(21) Appl. No.: 16/541,051

(22) Filed: Aug. 14, 2019

(65) Prior Publication Data

US 2020/0058287 A1 Feb. 20, 2020

(30) Foreign Application Priority Data

Aug. 20, 2018 (EP) ..... 18189719

(51) Int. Cl.
*G10K 11/178* (2006.01)
*H04R 1/10* (2006.01)

(52) U.S. Cl.
CPC .. *G10K 11/17853* (2018.01); *G10K 11/17823* (2018.01); *H04R 1/1008* (2013.01); *H04R 1/1016* (2013.01); *G10K 2210/1081* (2013.01); *G10K 2210/3026* (2013.01); *G10K 2210/3028* (2013.01)

(58) Field of Classification Search
None
See application file for complete search history.

(56) References Cited

U.S. PATENT DOCUMENTS

| | | | |
|---|---|---|---|
| 5,182,774 | A | 1/1993 | Bourk |
| 9,894,452 | B1 | 2/2018 | Termeulen et al. |
| 2008/0298624 | A1 | 12/2008 | Jeong et al. |
| 2009/0080670 | A1 | 3/2009 | Solbeck et al. |

(Continued)

FOREIGN PATENT DOCUMENTS

EP 3001695 A1 3/2016

OTHER PUBLICATIONS

U.S. Patent and Trademark Office, Non-Final Office Action in U.S. Appl. No. 16/535,486, dated Mar. 19, 2020, 8 pages.

(Continued)

*Primary Examiner* — Kenny H Truong
(74) *Attorney, Agent, or Firm* — Raven Patents, LLC; Anton E Skaugset

(57) ABSTRACT

Active noise-cancelling (ANC) headphones in the form of a part of a headset or as in-ear headphones that reduce acoustic adaptation by providing an electrodynamic speaker in a housing with ventilation openings and an acoustically permeable front panel. These components form a module that can be integrated into ANC headphones, permitting its installation in different headphones without customization. The module reacts to a reduction of the impermeability situation in such a manner, that an impedance change of the speaker takes place below 100 Hz. For example, a microphone and electronics with a feedback filter for active noise cancellation can be provided that form a secondary route between speaker and microphone. In a further development, an evaluation unit is provided which detects and evaluates a change in the impedance of the speaker and adapts the feedback loop.

6 Claims, 8 Drawing Sheets

(56) References Cited

U.S. PATENT DOCUMENTS

| | | | | |
|---|---|---|---|---|
| 2011/0007907 | A1* | 1/2011 | Park | G10K 11/178 381/71.8 |
| 2011/0116643 | A1 | 5/2011 | Tiscareno | |
| 2012/0070022 | A1 | 3/2012 | Saiki | |
| 2013/0343564 | A1 | 12/2013 | Darlington | |
| 2014/0226832 | A1 | 8/2014 | Shimizu | |
| 2015/0023542 | A1 | 1/2015 | Shimizu | |
| 2016/0142806 | A1 | 5/2016 | Lee et al. | |
| 2016/0330546 | A1* | 11/2016 | Barrentine | H04R 3/04 |
| 2018/0091883 | A1* | 3/2018 | Howes | H04R 1/1008 |
| 2020/0084535 | A1 | 3/2020 | Permann et al. | |

OTHER PUBLICATIONS

Office action in corresponding EP patent application 18189719.0-1210, dated Feb. 19, 2021.

* cited by examiner

ACTIVE NOISE-CANCELLING HEADPHONES

TECHNICAL FIELD

The invention relates to ANC (Active Noise Cancelling) headphones, which may also be part of a headset worn over or on the ear, or may be in-ear headphones, in accordance with the introductory part of claim 1.

BACKGROUND

Typically, during the production of such headphones, the one or more than one speaker, the microphone, and the associated electronics are installed separately in the designated headphone housing. In doing so, acoustic fine-tuning must be carried out for each headphone housing, involving tests and the corresponding effort.

For an ANC headphone, whether solely for the purpose of noise suppression or to convey acoustic signals, EP3 001 695 discloses measuring the output signal of the microphone in at least two frequency ranges and concluding from the results whether the headset is being worn or not and—in case it is not being worn—to turn it off or to switch it to a power saving mode.

A similar feature is disclosed in U.S. Pat. No. 9,894,452: in an in-ear headset which is optionally equipped with ANC, the execution of a Fourier transformation of the output of a microphone and evaluation of the result determines whether the plug is located in the ear or not. The response provides for the switching off of the speaker; additionally, and optionally, feedback to a mobile phone is provided.

Regarding the headphones mentioned above, it is necessary to consider the various installation situations of the components within the housing, and to carry out the acoustic fine-tuning in a necessarily sensitive and complex operation for each installation situation, which almost inevitably results in changes and adaptations of the original installation planning. In addition, there is a noticeable change in the acoustic behavior, which, when the headset is badly seated against the user, is always degradation causing leakage resulting in the creation of a direct connection of the volume between the user and the cushion and the environment. It is then quite possible that the ANC circuit produces not a dampening of the ambient noise but an unstable feedback which can build up and produce unpleasant and shrill sounds for the user.

When such a headphone is improperly put on or in by the user, the acoustic condition change in regard to the tuning condition, and the quality of both signal transmission and noise dampening suffer.

To avoid this, it has been proposed to conduct a calibration prior to use of the headset but with the headset already in place; but this complex procedure, which is applicable only in special cases, has no benefit if the seat of ANC headphones on the ear of the user changes during use.

There is thus a need for an ANC headphone of the type mentioned above, in which different installation situations as well as changing user situations have no significant effect on the quality of the listening experience and, in particular, the ANC function is preserved. The goal and object of the invention is the proposal of a solution to this problem.

SUMMARY

According to the invention, these objectives are achieved through the features specified in the characterizing part of claim 1, in other words, through creation of an ANC module, also called an ANC component, with its own housing with ventilation openings, in which an electrodynamic speaker is provided and which is optionally closed with an acoustically permeable front panel, this module optionally also being equipped with a microphone and electronics for active noise cancellation and/or a data line for input of the acoustic output signal and/or a power supply or connections for such components.

This ANC module is incorporated into the headphones as a single part in such a manner that the front panel is directed towards the user's ear when the headphones are in use. The invention relates to such modules as well as to headphones into which such modules are installed.

Such an ANC module, which per se is also an aspect of the invention, allows for the detection of a change of the impedance at the speaker terminals when a (geometrical) change as compared to the initial situation takes place (such as through slipping of the headphones or the like), and that based on this condition, parameters within the ANC circuit are adjusted accordingly, for which models and control loops in the electronics or their software are provided. In contrast to the two documents mentioned above, the headphones are not switched off when a change of the wearing situation takes place; instead, the tuning of the transmission is adjusted.

It is thus also possible to install the very same ANC module in various housings (which could be viewed as "a change as compared to the initial situation"), without having to perform any fine-tuning, as well as to always achieve an acoustic tuning that adapts itself to varying wearing situations without input from the user.

BRIEF DESCRIPTION OF THE DRAWINGS

The invention is explained in more detail below with reference to the drawing, in which FIG. 1 purely schematically shows an ANC module according to the invention.

DETAILED DESCRIPTION

As already briefly stated, the ANC loop microphone may be part of the ANC module or independently mounted on the headphone, as the positioning of the microphone does not affect the function of the ANC module. It is important that the impedance of the speaker in this module responds to leaks in the front volume or in different situations, to allow for deduction of the state of the transmission path from the speaker to the ANC microphone. Thus, even in a worst-case scenario, it is possible for the electronics of the headphones to recognize when a certain leak has occurred and to ultimately switch off the ANC for the protection of the user, before it becomes unstable.

Figure 1:
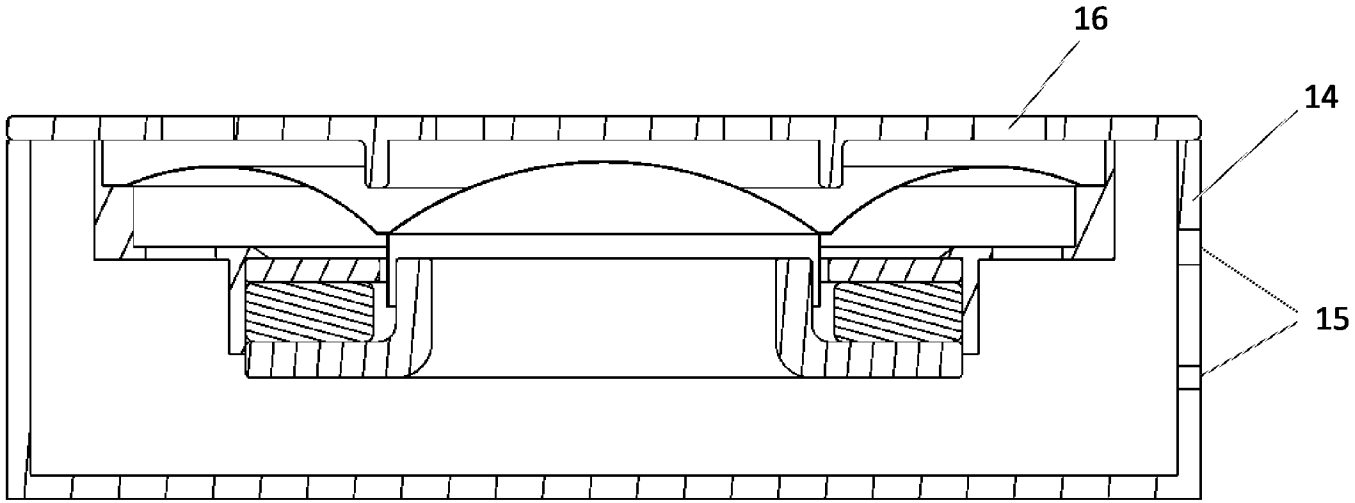

FIG. 1 purely schematically shows an ANC module according to the invention with electrodynamic speaker 1 arranged in housing 14, and acoustically permeable front panel 16, providing for a connection to housing 14. One or more ventilation openings 15 are provided in housing 14. Form and design of both housing and module may greatly vary from the illustrated embodiment; only the essential parts per se are shown. In this basic version, electronics and ANC microphone are housed elsewhere within the headphones; if the headphones are also designed for transmission of a signal (speech, music, telephone, etc.), a data line according to the state of the art is also provided, otherwise only the required equalizing information is relayed to speaker 1 via a line (not shown).

Figure 2:
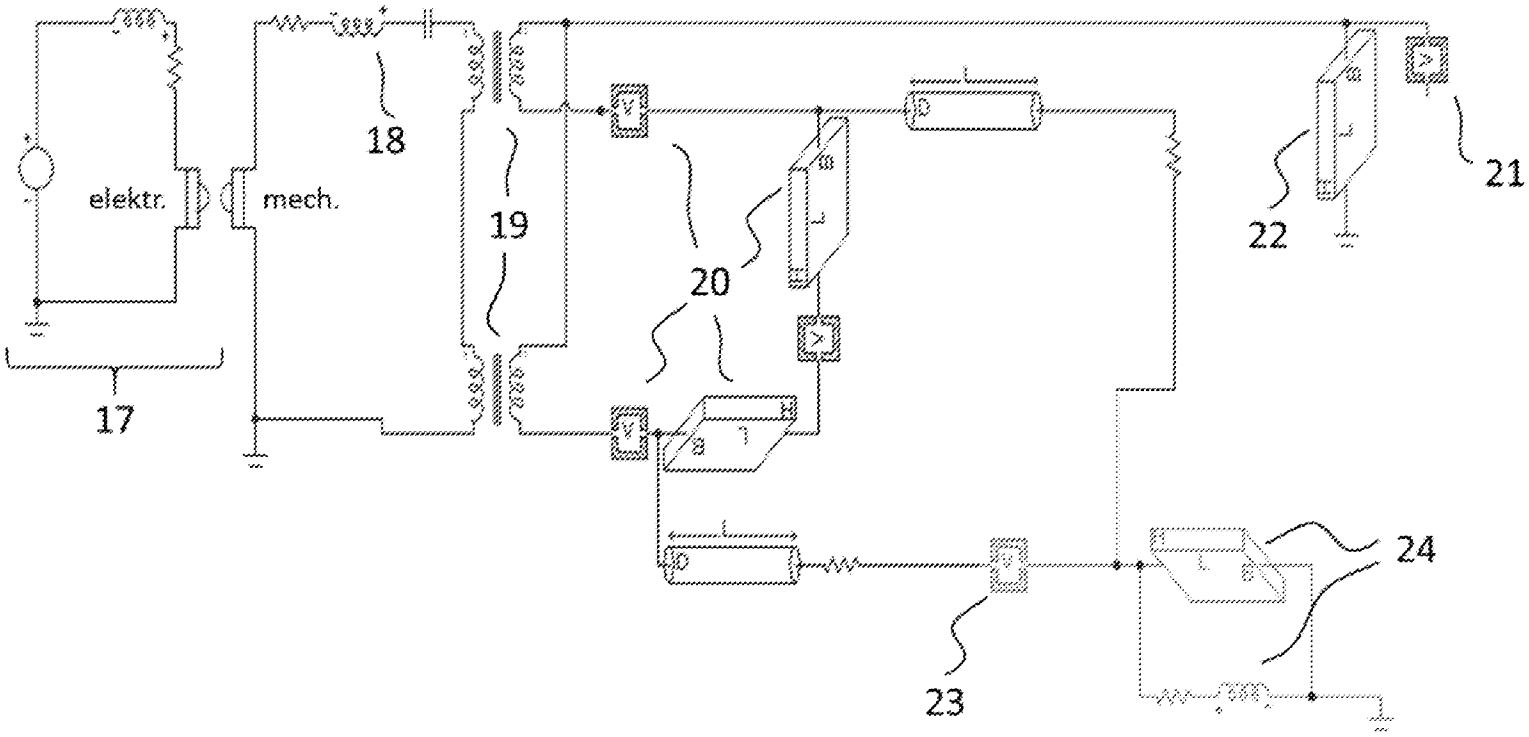
FIG. 2 shows an acoustic parameter model of the ANC module.

FIG. 2 shows an acoustic parameter model of the ANC module according to the invention: The model shows the electrical supply by means of generator via coil 17. 18 simulates the mechanical oscillating circuit of the membrane and the coil. It is coupled to the environment via membrane surface 19. 20 illustrates the internal speaker geometries. 21 depicts the front volume or volume between speaker and ear, which is short-circuited to ground via a simulated leak 22. 23 simulates the back volume of module 23, which is connected to the free field (module surroundings) via openings 24 (corresponds to opening 15 of FIG. 1). In order to provide for a reaction of leak 22 to transducer oscillating circuit 18, openings 24 must be adjusted accordingly, i.e. they must be open enough.

Figure 3:
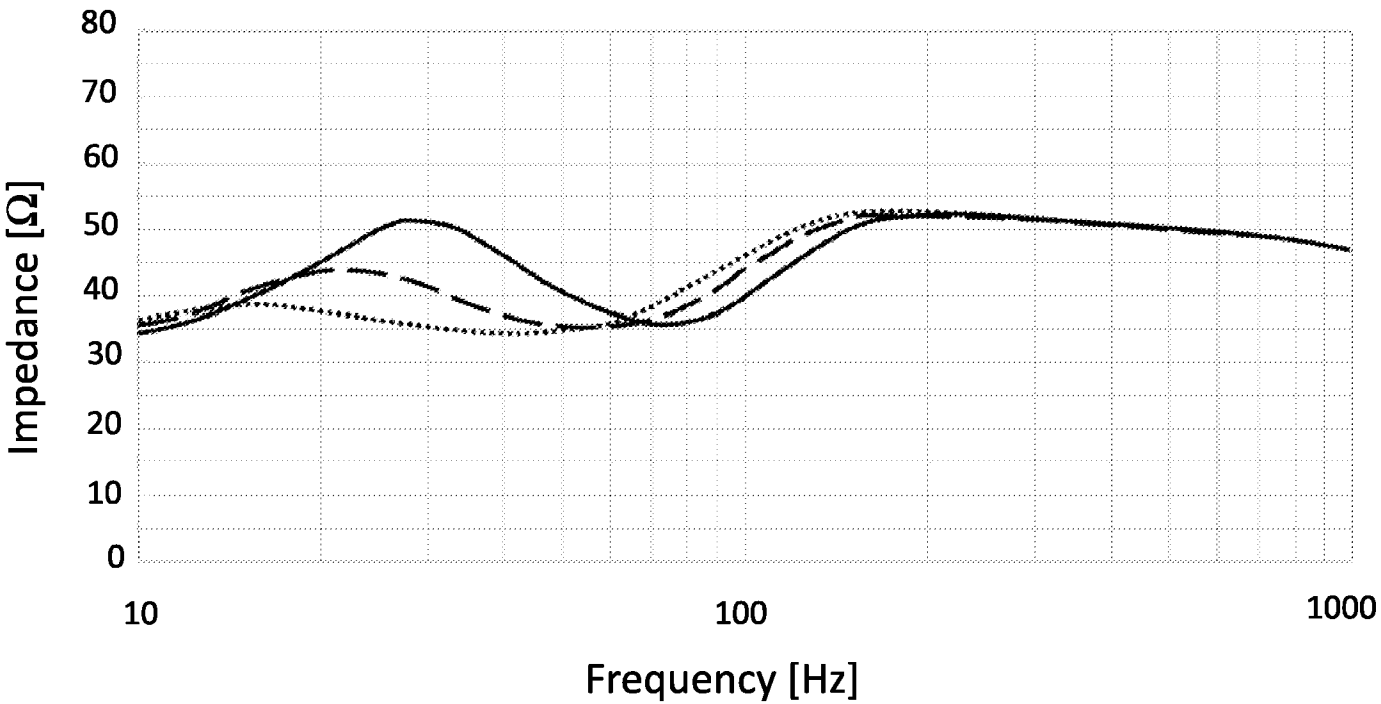
FIG. 3 shows a simulation of the frequency response with a front volume of 200 $cm^3$.

FIG. 3 shows a simulation of the frequency response of headphones according to the invention with an ANC module according to the invention with a front volume of 200 $cm^3$. The frequency response over frequency is plotted on a logarithmic scale: The solid line shows the fully open situation, the dotted line the fully closed situation, and the dashed line a small leak. As can be seen from the figure, the increase of the leak results in a significant increase in impedance in the range below 100 Hz. This can be measured and evaluated. In the illustrated example, the impedance increase relative to the low point in the range of 70 Hz is +25% for a small leak and +44% for the fully open situation.

Figure 4:
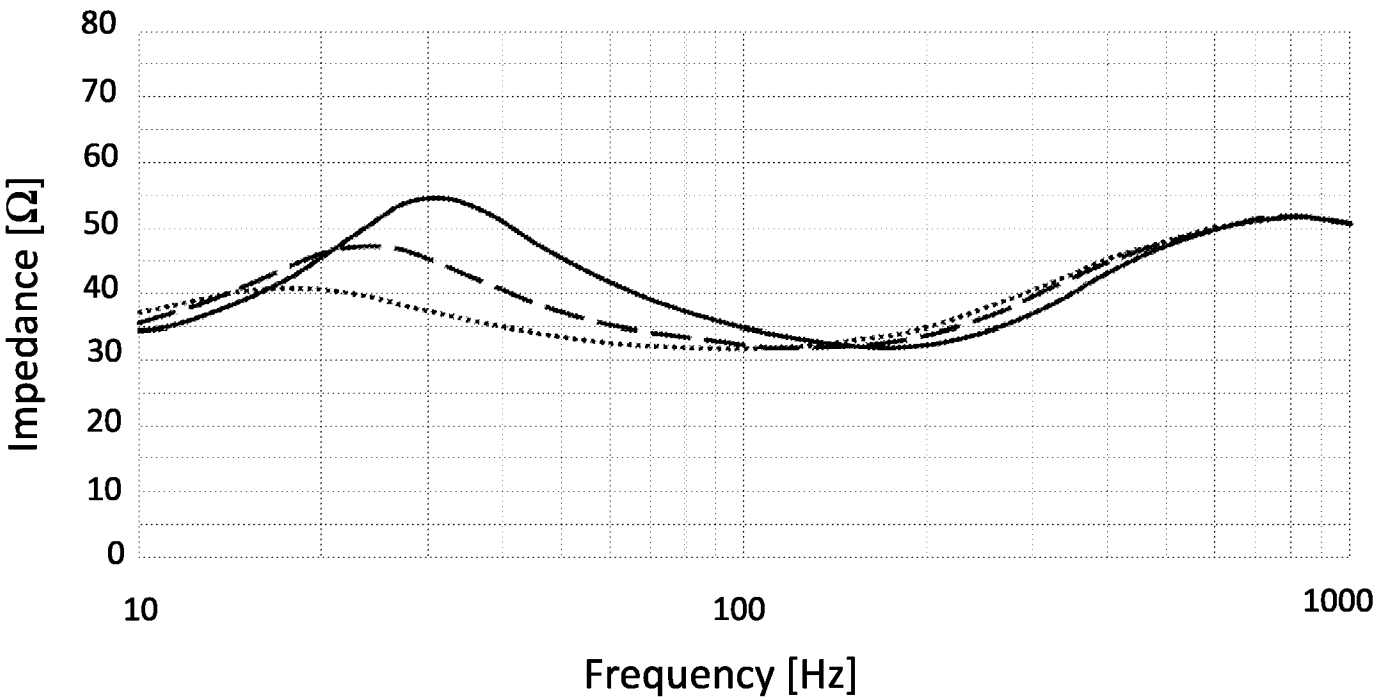
FIG. 4 shows an analog simulation of the frequency response with a front volume of 40 $cm^3$.

Analogously to this, FIG. 4. shows the frequency response at a front volume of only 40 $cm^3$, analogously to the situation in FIG. 3. The solid line shows the fully open situation, the dotted line the fully closed situation, and the dashed line the situation with a small leak. A significant increase in impedance below 100 Hz due to enlargement of a leak is once again visible. In the illustrated example, the impedance increase relative to the low point in the range of 150 Hz is +47% for a small leak and +72% for the fully open situation.

This increase in impedance is used according to the invention for determining the wearing situation (or the installation situation) and leads to an adaptation of the signal transmission and/or the noise damping.

Figure 5:
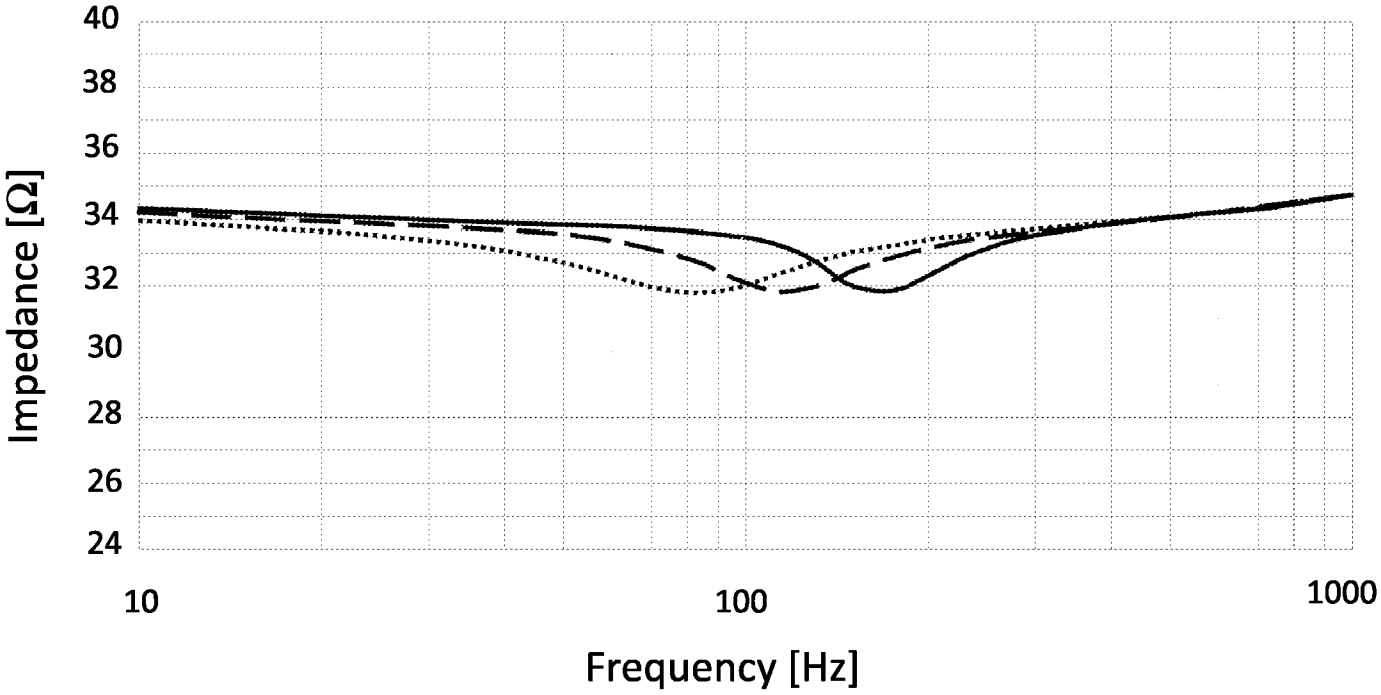
FIG. 5 shows a simulation of the frequency response of a headphone according to the state of the art.

In comparison, FIG. 5 shows the frequency response of an otherwise equal headphone according to the state of the art. The solid line shows the fully open situation, the dotted line the fully closed situation, and the dashed line the situation with a small leak. Here, only a minimal change in the impedance curve in the range of a few percent is visible (here: a change of only 8%), which makes drawing a conclusion concerning the wearing situation difficult.

Figure 6:
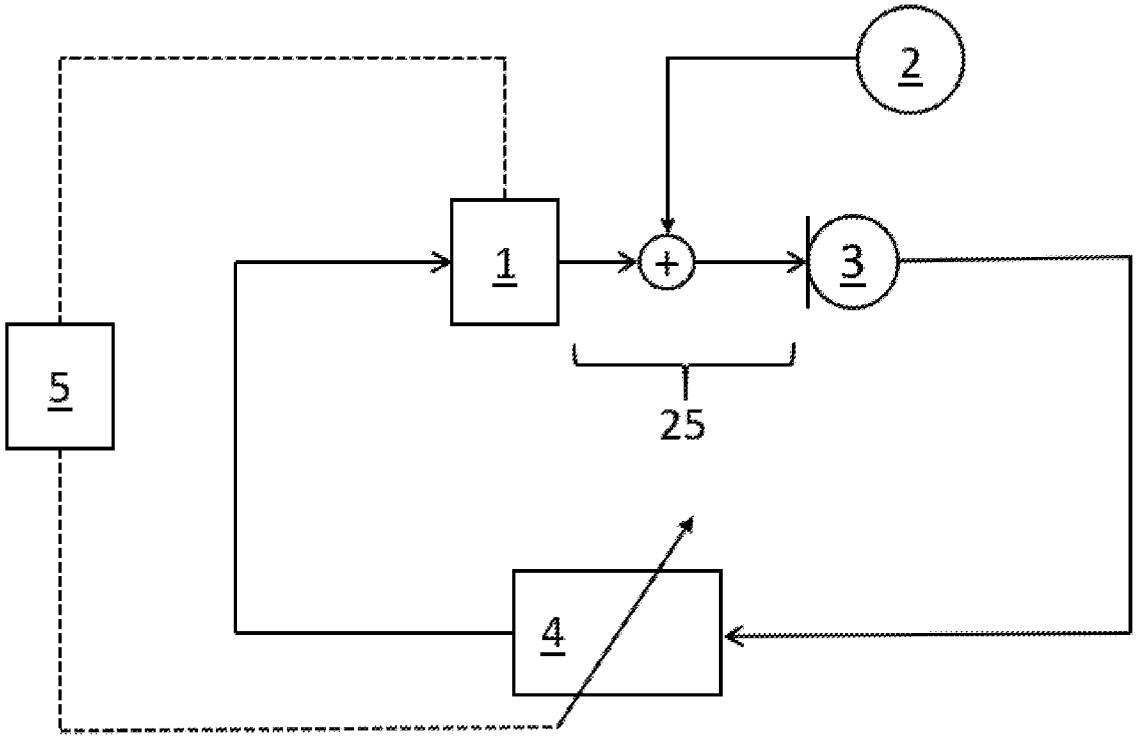
FIG. 6 shows an ANC block diagram relating to the feedback.

FIG. 6 is a block diagram of the feedback loop used according to the invention: The sound of a speaker 1 is superimposed by an interfering signal 2 coming from the outside, which is picked up by feedback microphone 3 and transmitted to feedback filter 4. Corresponding secondary path 25 is sketched in between speaker 1 and feedback microphone 3. An ideal feedback filter is calculated by means of electronics known in the state of the art, and a corresponding signal is transmitted to speaker 1. The arrow in filter 4 purely schematically indicates an audio signal possibly to be provided, as it is immaterial to the invention.

An evaluation of the impedance path of the speaker in evaluation unit 5 leads to the adaptation of feedback filter 4. Depending on the recognizable wearing situation and/or the desired behavior, this adaptation may vary. For example, individual filter groups may be changed or deactivated. A reduction of the entire loop amplification or a full deactivation of the loop is also conceivable or feasible. Knowing the invention and the field of application, a person skilled in the art of ANC headphones will easily be able to here take the appropriate measures.

Evaluation unit 5 may react in various ways to the change of impedance and in this regard, it is not part of the invention. An example would be reacting to the impedance level and to deactivate/bridge a filter stage when a threshold value is reached or exceeded, as explained with reference to FIG. 8.

Figure 7:
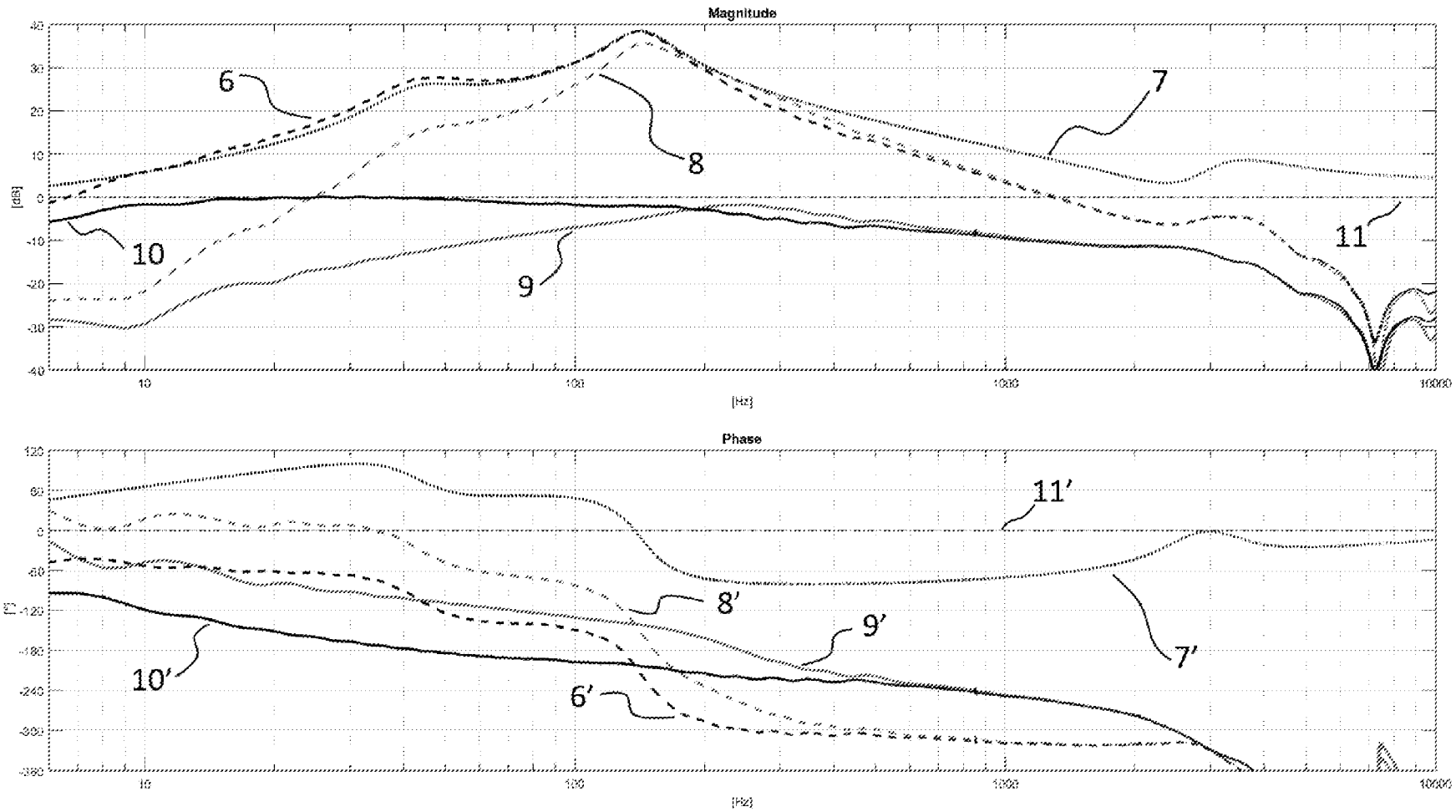
FIG. 7 shows the behavior of the frequency response during occurrence of a leak during original ideal tuning according to the state of the art.
Figure 8:
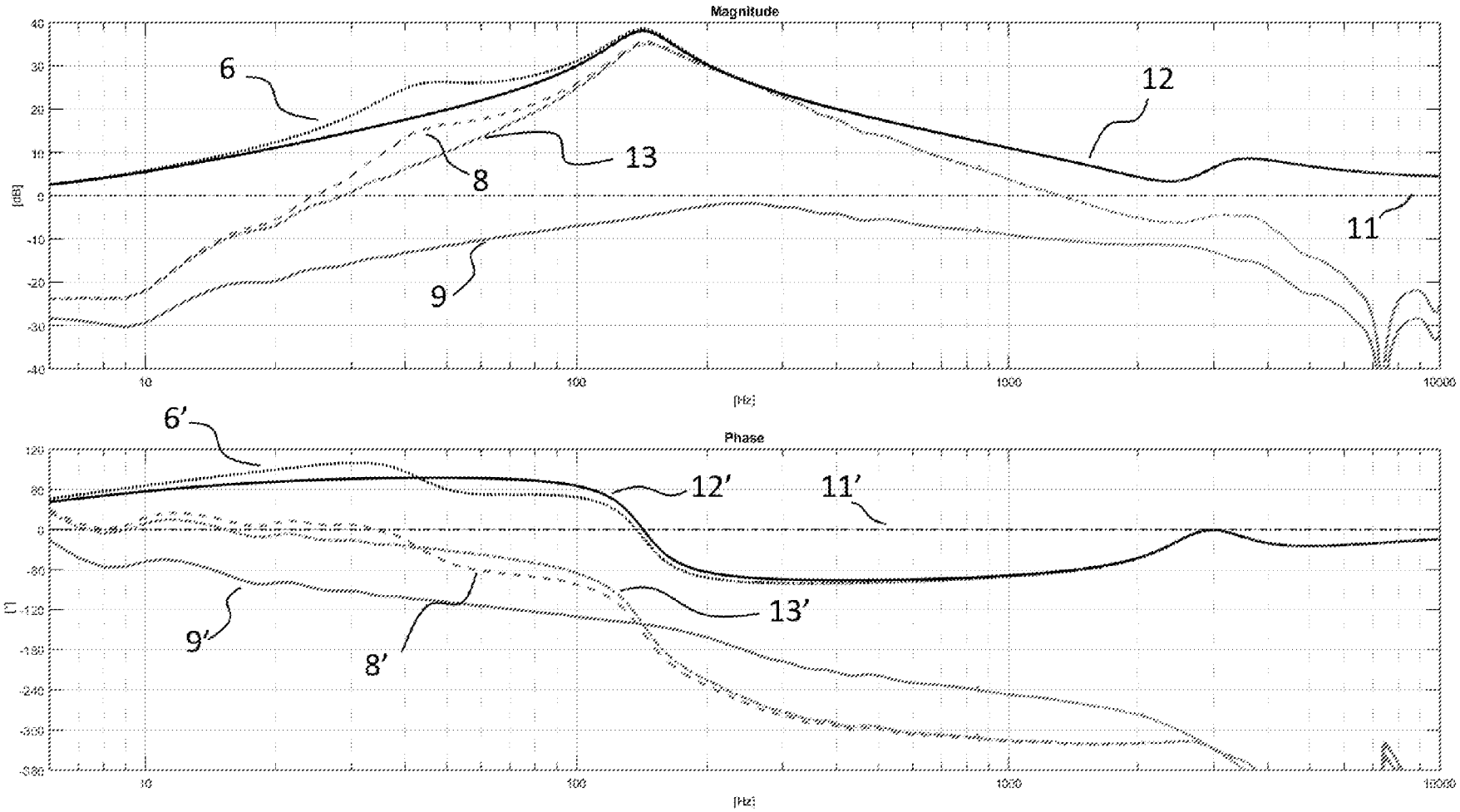
FIG. 8 shows the correction achieved according to the invention compared to FIG. 7.

FIGS. 7 and 8 show the frequency response, both amplitude and phase, with 11 and 11', respectively, indicating the stability limit for the closed loop, 9 and 9' indicating the secondary route in the leaky state, 10 and 10' indicating the secondary route in the impermeable state, 7 and 7' indicating the ideal feedback filter according to the state of the art.

FIG. 7 shows the impermeable and leaky wearing situation illustrated in the secondary route with lines 10 and 9. If ideal filter 7 (according to the state of the art, thus ideally adapted when perfectly seated) is superimposed, progression 6 is achieved in an impermeable wearing situation, and no problem is identified. The phase margin (at magnitude=0 dB) is >40° at 7 Hz and 1200 Hz. Thus, the control loop is stable. In the leaky wearing situation with ideal filter 7 (according to the state of the art), progression 8 is achieved and the phase margin is below 0° (at 24 Hz, magnitude=0 dB). 0°-phase is achieved at 33 Hz, with the magnitude being at approximately +10 dB. Thus, the control loop is unstable.

With the filter according to the invention, FIG. 8 shows analogously to FIG. 7 the impermeable and leaky wearing situation with the ideal filter (according to the state of the art) leading to progressions 6 and 8, respectively, as well as with the adapted filter according to the invention leading to progressions 12 and 13, respectively. With an adapted filter and the leaky wearing situation (13), in contrast to (8) no problem can be identified. The phase margin (at magnitude=0 dB) is >20° at 29 Hz. Thus, the control loop is once again stable with the adapted filter. For comparison, the progressions with ideal filter 6, 6' and 8, 8' according to the state of the art have also been plotted.

Thus, the use of a module according to the invention with a feedback filter according to the invention is always particularly indicated when the occurrence of instabilities must be reliably avoided, but in other cases, their use significantly improves the result and thus the hearing experience or noise suppression.

In principle, for interpretation and especially for contesting the property rights, but also in interpreting the same as state of the art, the following definitions are stated:

In the description and claims, the terms "front", "rear", "top", "bottom", "inside", "outside", etc. are used in their common form and with reference to the object in its usual position of use. That is, in the case of a weapon, the mouth of the barrel is in "front", the slide is moved to the "rear" by the explosion gases, in the use position the sound opening of a headset is "directed towards the user's ear", etc. Perpendicular to a given direction essentially means a direction rotated by 90° thereto.

In the description and the claims, "substantially" means a deviation of up to 10% of the stated value, if this is physically possible, both downwards and upwards, otherwise only in the sensible direction; in regard to values of degrees (both angle and temperature) this means ±10°.

All quantities and proportions, in particular those for delimiting the invention, as far as they do not relate to the specific examples, are to be understood with ±10% tolerance, thus, for example: 11% means: from 9.9% to 12.1%. For terms such as "a solvent", the word "a" is not to be regarded as a numerical word but as an indefinite article or as a pronoun, unless the context indicates otherwise.

The term: "combination" or "combinations" denotes, unless otherwise stated, all types of combinations, beginning with two of the relevant constituents, to a plurality or all of such constituents; the term "containing" also means "consisting of".

The characteristics and variants specified in the individual embodiments and examples can be freely combined with those of the other examples and embodiments and may in particular be used to characterize the invention in the claims without compulsory entrainment of the other details of the respective embodiment or the respective example.

LIST OF REFERENCE SYMBOLS

1: Speaker
2: Interfering Signal
3: Feedback Microphone
4: Feedback Filter
5: Impedance Response Evaluation of the Speaker
6: Amplitude Response Secondary Route (impermeable)+Ideal Feedback Filter (for impermeable wearing situation)
6': Phase Response Secondary Route (impermeable)+Ideal Feedback Filter (for impermeable wearing situation)
7: Amplitude Response, Ideal Feedback Filter (for impermeable wearing situation)
7': Phase Response, Ideal Feedback Filter (for impermeable wearing situation)
8: Amplitude Response Secondary Route (leaky)+Ideal Feedback Filter (for impermeable wearing situation)
8': Phase Response, Secondary Route (leaky)+Ideal Feedback Filter (for impermeable wearing situation)
9: Amplitude Response, Secondary Route (leaky)
9': Phase Response, Secondary Route (leaky)
10: Amplitude Response, Secondary Route (impermeable)
10': Phase Response, Secondary Route (impermeable)
11: Stability Limit Amplitude, for Closed Control Circuit (=0 dB)
11': Stability Limit Phase, for Closed Control Circuit (0°>angle>−360)
12: Amplitude Response, Adjusted Feedback Filter for Stable Leakage Situations
12': Amplitude Response, Adjusted Feedback Filter for Stable Leakage Situations
13: Amplitude Response, Secondary Route (leaky)+Adapted Feedback Filter (for leaky wearing situation)
13': Phase Response, Secondary Route (leaky)+Adapted Feedback Filter (for leaky wearing situation)
14: Housing
15: Ventilation Openings
16: Front Panel
17-24: Parameter Model
25: Secondary Route

What is claimed is:

1. An active noise-cancelling module, comprising:
a module housing having one or more ventilation openings, the module housing being closed with an acoustically-permeable front panel;
an electrodynamic speaker provided in the module housing;
a microphone; and
electronics including a feedback filter configured to perform active noise cancellation;
wherein the module is physically and acoustically configured so that when the module is integrated into an active noise-cancelling headphone, a reduction of a seal of the headphone results in a change of impedance of the electrodynamic speaker at a frequency below 100 Hz;
wherein the active noise-cancelling headphone is further configured so that the change of the impedance of the electrodynamic speaker results in an adaptation of the configuration of the feedback filter such that the feedback filter continues to perform active noise cancellation; and
wherein the module is configured to be incorporated into a housing of an active noise-cancelling headphone as a single part.

2. The active noise-cancelling module of claim 1, wherein the module is configured to be incorporated into a housing of an active noise-cancelling headset that is worn over or on an ear, or configured to be incorporated into a housing of an active noise-cancelling in-the-ear headphone.

3. The active noise-cancelling module of claim 1, further comprising a connection for an input of an acoustic output signal, the connection forming a secondary route between the electrodynamic speaker and the microphone.

4. An active noise-cancelling headset or in-the-ear headphone, comprising
an active noise-cancelling module, the active noise-cancelling module including
a module housing having one or more ventilation openings, the module housing being closed with an acoustically-permeable front panel; and
an electrodynamic speaker provided in the module housing;
wherein the module is physically and acoustically configured so that a reduction of a seal of the headset or headphone results in a change of impedance of the electrodynamic speaker at a frequency below 100 Hz;
wherein the changing of the impedance of the electrodynamic speaker results in an adaptation of the feedback filter such that the feedback filter continues to perform active noise cancellation; and
wherein the active-noise-cancelling module is incorporated into a housing of the headset or headphone as a single part.

5. The headset or headphone of claim 4, wherein the active noise-cancelling module further includes a microphone and an electronic circuit incorporating a feedback filter configured to perform active noise cancellation.

6. The headset or headphone of claim 5, wherein the active noise-cancelling module further includes a connection for an input of an acoustic output signal, where the connection forms a secondary route between the electrodynamic speaker and the microphone.

* * * * *